US007874440B2

(12) United States Patent
Gnepper

(10) Patent No.: US 7,874,440 B2
(45) Date of Patent: Jan. 25, 2011

(54) CHILD-RESISTANT PACKAGE

(75) Inventor: Maurice R. Gnepper, Fremont, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 933 days.

(21) Appl. No.: 11/450,835

(22) Filed: Jun. 9, 2006

(65) Prior Publication Data

US 2007/0284372 A1 Dec. 13, 2007

(51) Int. Cl.
*B65D 55/02* (2006.01)

(52) U.S. Cl. ..... 215/222; 215/216; 215/217; 215/221; 215/223; 215/230; 220/4.21; 206/581; 401/126; 132/293; 132/294; 132/295; 132/300; 132/301

(58) Field of Classification Search ..... 215/216, 215/217, 221, 222, 223, 330; 220/4.21; 206/581; 132/293, 294, 295, 300, 301; 401/126
See application file for complete search history.

(56) References Cited

U.S. PATENT DOCUMENTS

| | | | | |
|---|---|---|---|---|
| 4,093,103 | A | 6/1978 | Mumford | |
| 4,149,646 | A | 4/1979 | Julian | |
| 4,273,248 | A | 6/1981 | Lehmann | |
| 5,160,057 | A | 11/1992 | Fitjer | |
| 5,230,433 | A | 7/1993 | Hamilton et al. | |
| 5,238,130 | A | 8/1993 | Marques et al. | |
| 5,297,732 | A * | 3/1994 | Hahn | 239/55 |
| 5,377,858 | A | 1/1995 | Morris, Sr. | |
| 5,687,863 | A | 11/1997 | Kusz | |
| 5,722,546 | A | 3/1998 | Briere | |
| 5,836,467 | A | 11/1998 | Montgomery | |
| 5,865,330 | A * | 2/1999 | Buono | 215/216 |
| 5,992,656 | A | 11/1999 | Dujardin et al. | |
| 6,003,700 | A | 12/1999 | Julian et al. | |
| 6,036,036 | A | 3/2000 | Bilani et al. | |
| 6,112,921 | A * | 9/2000 | Robinson | 215/216 |
| 6,367,640 | B1 | 4/2002 | Julian | |
| 6,709,325 | B2 | 3/2004 | Korsen | |
| 6,871,752 | B2 | 3/2005 | Montgomery | |
| 2003/0047937 | A1 * | 3/2003 | Chaduc et al. | 283/81 |
| 2004/0222181 | A1 | 11/2004 | Biesecker et al. | |
| 2005/0106340 | A1 * | 5/2005 | Baker | 428/34.1 |

* cited by examiner

*Primary Examiner*—Anthony Stashick
*Assistant Examiner*—Elizabeth Volz
(74) *Attorney, Agent, or Firm*—Reising Ethington PC

(57) ABSTRACT

A child-resistant package includes first and second elements having base walls with rectangular peripheries, continuous peripheral walls extending around the peripheries, locking projections or tabs on opposed sections of the peripheral walls, and cylindrical walls extending from the base walls within the peripheral walls and having thread segments. The second element is threadable onto the first element to bring the peripheral walls into aligned abutment and the locking tabs into engagement with the locking projections to resist unthreading of the elements. The peripheral wall of the second element is inwardly flexible and resilient adjacent to the locking tabs to permit manual movement of the locking tabs inward from the locking projections so that the elements can be unthreaded from each other.

22 Claims, 6 Drawing Sheets

CHILD-RESISTANT PACKAGE

The present disclosure relates to a child-resistant package, and more particularly to a compact-style child-resistant package that provides tamper indication.

BACKGROUND AND SUMMARY OF THE DISCLOSURE

A general object of the present disclosure is to provide an economical compact-style child-resistant package for containing tablets or the like.

The present disclosure embodies a number of aspects that can be implemented separately from or in combination with each other.

A child-resistant package in accordance with one aspect of the present disclosure includes a first element having a base wall with a rectangular periphery, a continuous peripheral wall extending around such periphery, at least a pair of locking projections internally disposed on opposed sections of the peripheral wall, and a cylindrical wall extending from the base wall within the peripheral wall and having at least one first thread segment. A second element has a base wall with a rectangular periphery and a continuous peripheral wall extending around the periphery, a pair of locking tabs centrally extending from opposed sections of the peripheral wall, and a cylindrical wall extending from the base wall within the peripheral wall and having at least one second thread segment. The second element is threadable onto the first element by means of the cylindrical walls and the first and second thread segments to bring the peripheral walls into aligned abutment and the locking tabs into engagement with the locking projections to resist unthreading of the elements. The peripheral wall of the second element is inwardly flexible and resilient adjacent to the locking tabs to permit manual movement of the locking tabs inward from the locking projections so that the elements can be unthreaded from each other. A label preferably extends at least from the base wall of the second element around abutting sections of the peripheral walls onto the base wall of the first element such that the label must be severed to permit unthreading of the elements to provide tamper indication for the package.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

The drawings illustrate a child-resistant compact-style package 10 in accordance with an exemplary embodiment of the disclosure. Package 10 includes a first element 12 hereinafter referred to as a "base" and a second element 14 hereinafter referred to as a "lid" threadably received on the base. The terms "base" and "lid" are used for purposes of description only and do not imply any limitation as to which element is disposed above the other.

Figure 5:
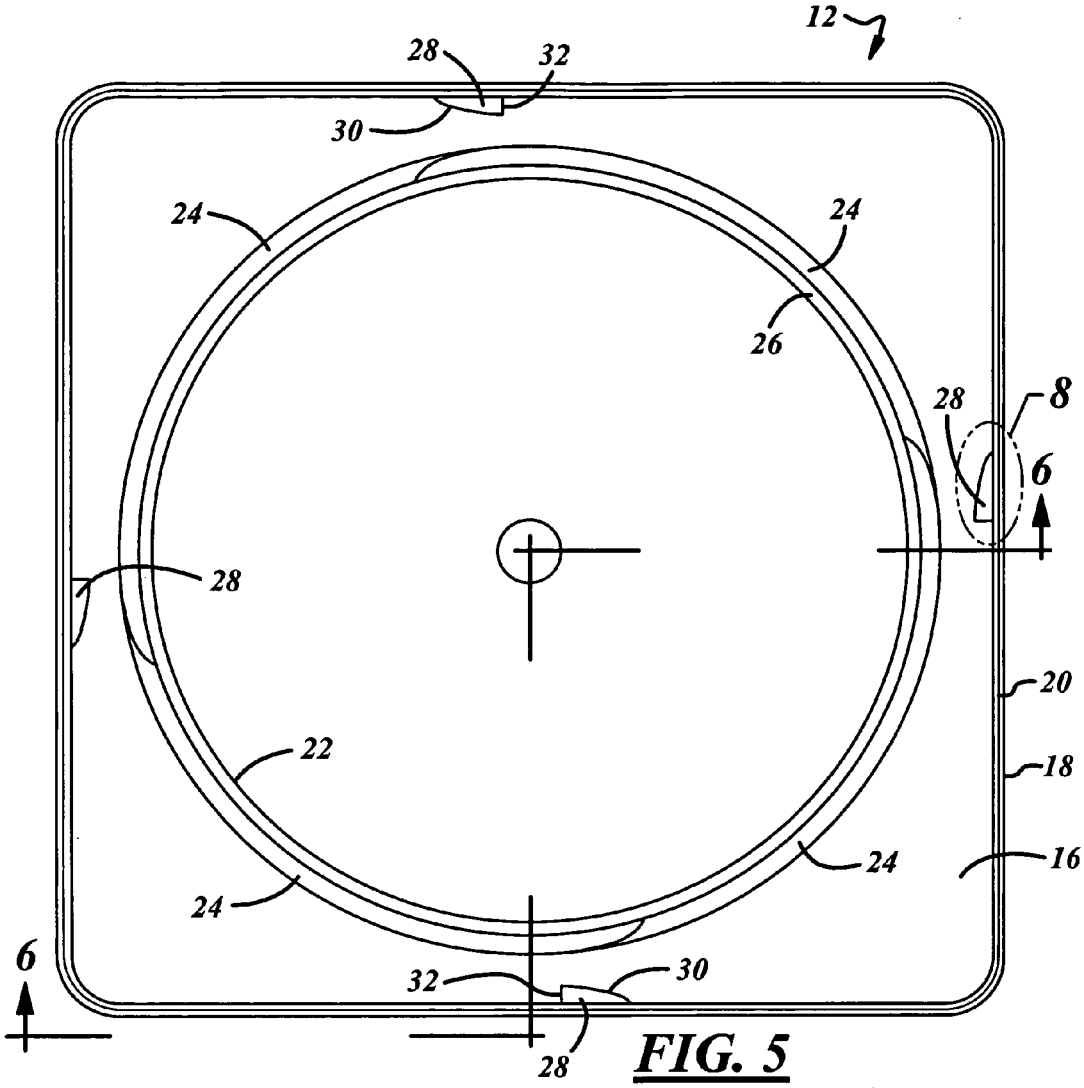
FIG. 5 is a top plan view of the lower package element in the package of FIGS. 1-4.

Base 12 (FIGS. 1-8) includes a base wall 16, which preferably is substantially flat and has a rectangular periphery that preferably is square. An upstanding continuous peripheral wall 18 extends entirely around the rectangular (preferably square) periphery of base wall 16 and has an upper edge 20 disposed in a plane that preferably is parallel to substantially flat base wall 16. A cylindrical wall 22 extends from base wall 16 within peripheral wall 18, preferably being substantially centrally disposed within peripheral wall 18. Cylindrical wall 22 has at least one external thread segment 24. In the illustrated exemplary embodiment of the disclosure, there are four external thread segments 24 with thread starts at 90° spacing from each other. Cylindrical wall 22 has an edge 26 that preferably lies in a plane parallel to the plane of peripheral wall edge 20. A locking projection 28 is internally disposed at least on opposed linear sections of peripheral wall 18. In the exemplary embodiment of the disclosure that includes four thread segments 24, there preferably is a locking projection 28 internally disposed on each linear section of peripheral wall 18. Each locking projection 28 includes a counterclockwise-facing cam surface 30 (in the orientation of FIG. 5) and a clockwise-facing abutment surface 32. The opposed pairs of locking projections 28 are generally centered on the peripheral wall sections but are slightly offset from each other, as best seen in FIG. 5, for purposes to be described. Base 12 preferably is of one-piece molded plastic construction such as polypropylene.

Figure 1:
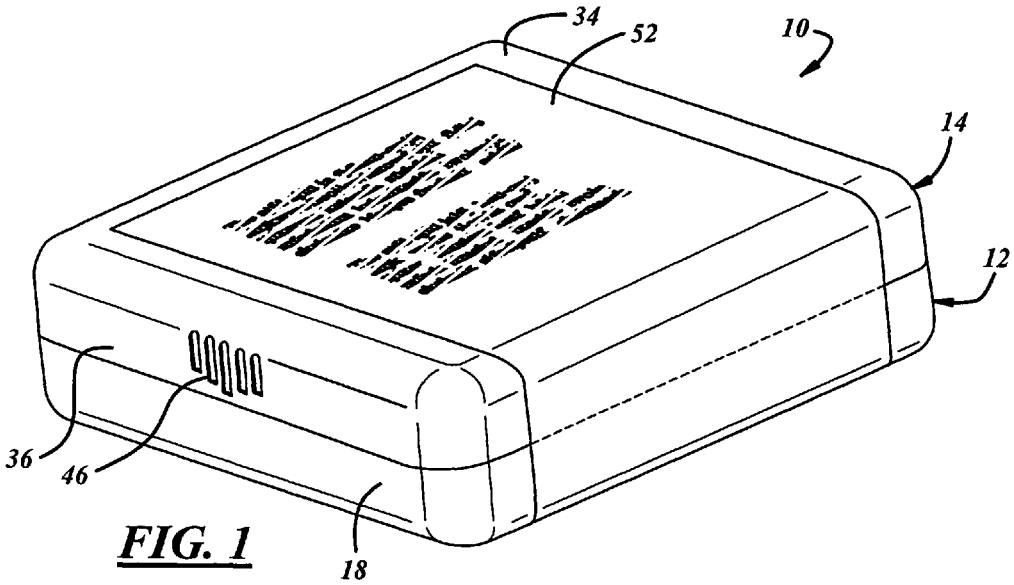
FIG. 1 is a perspective view of a package in accordance with an exemplary embodiment of the present disclosure.
Figure 2:
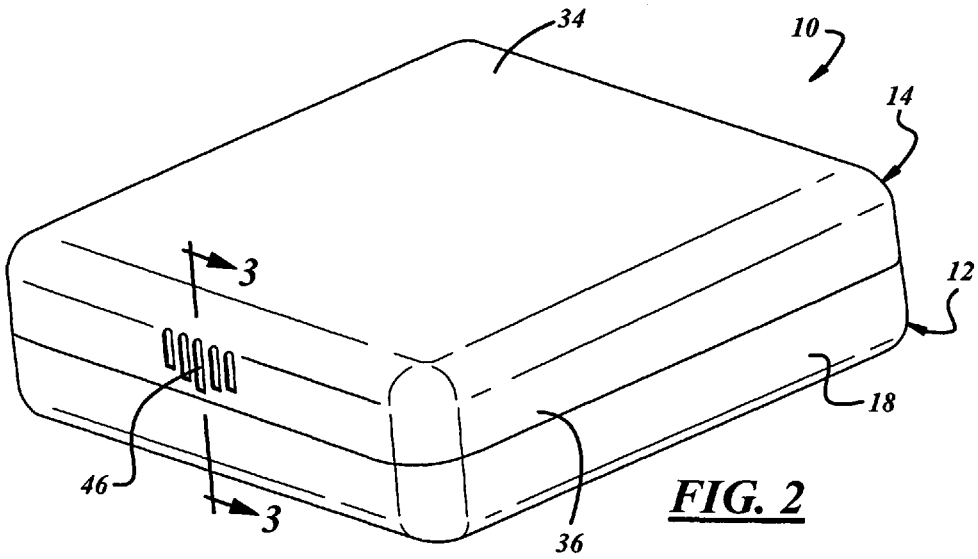
FIG. 2 is a perspective view of the package of FIG. 1 without the label.
Figure 3:
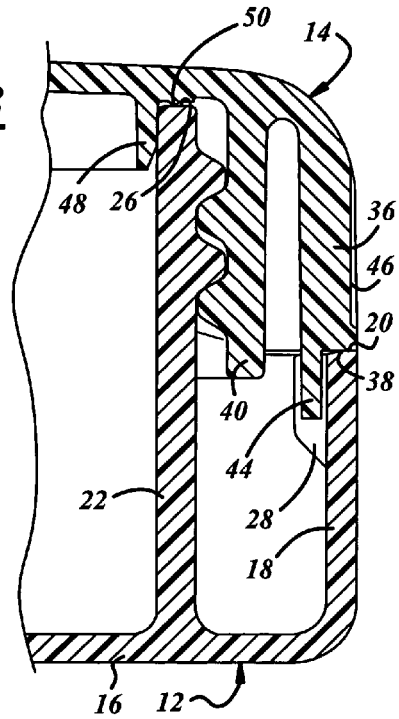
FIG. 3 is a fragmentary sectional view taken substantially along the line 3-3 in FIG. 2.
Figure 4:
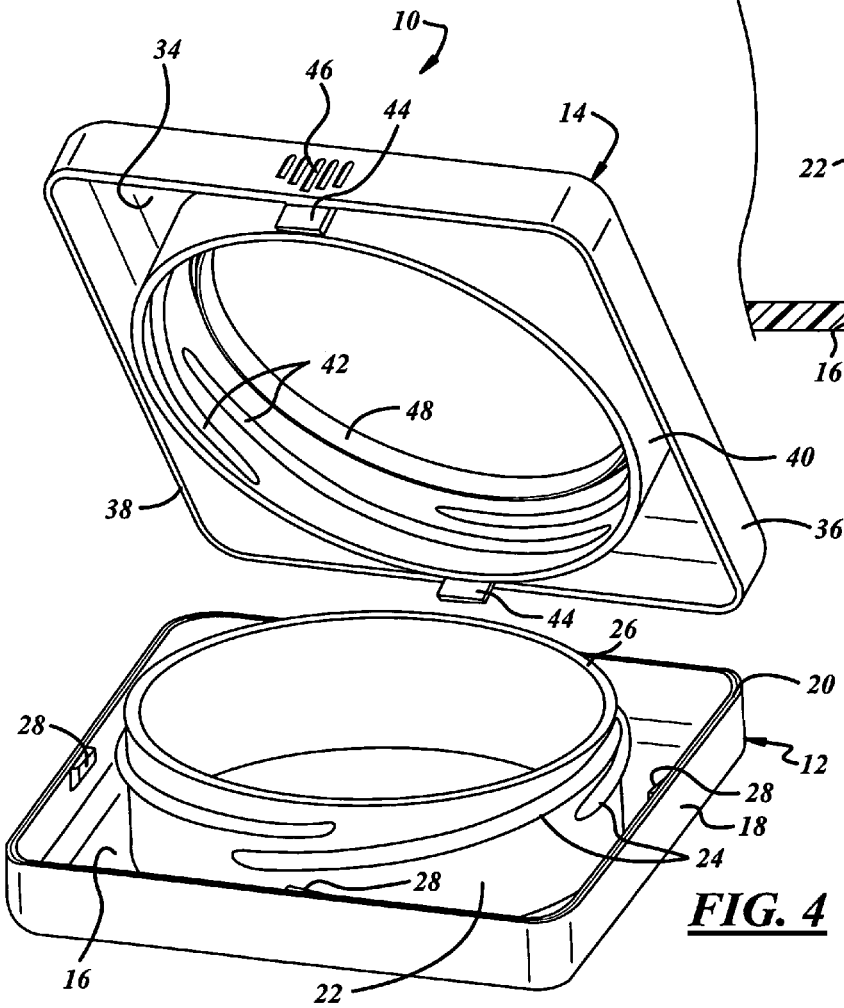
FIG. 4 is a perspective view of the package of FIG. 2 with the package elements separated from each other.
Figure 9:
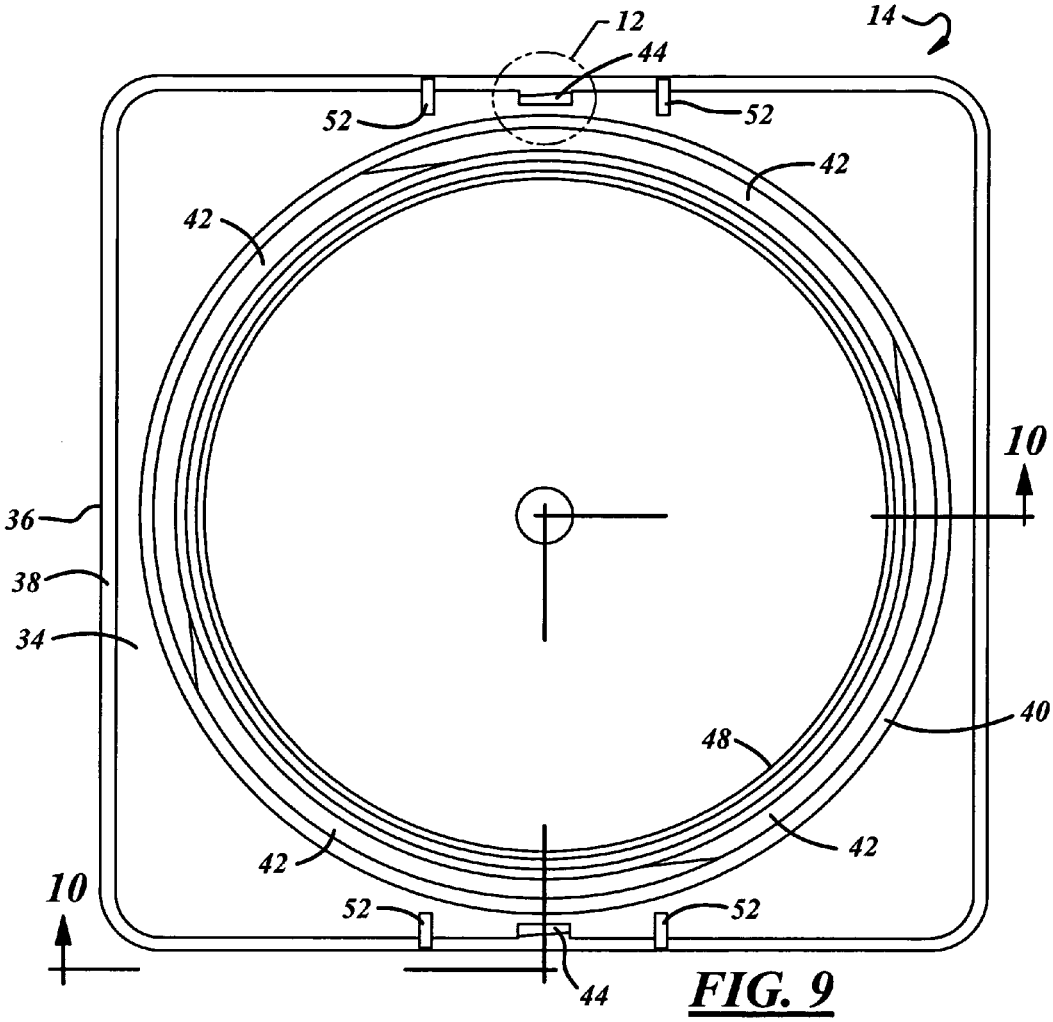
FIG. 9 is a bottom plan view of the upper package element in the package of FIGS. 1-4.
Figure 10:
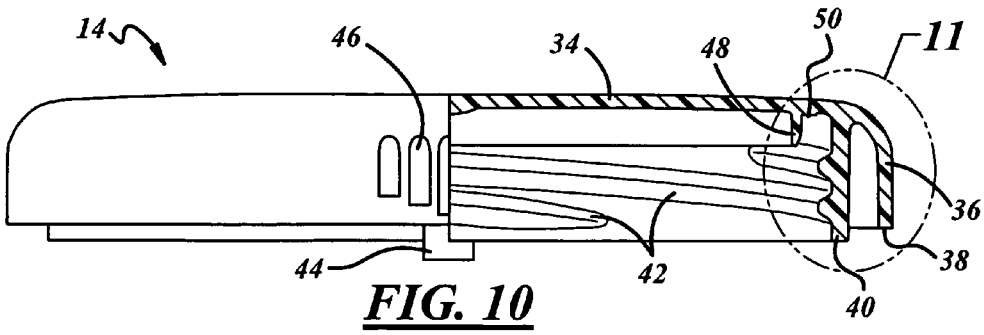
FIG. 10 is a sectional view taken substantially along the line 10-10 in FIG. 9.
Figure 11:
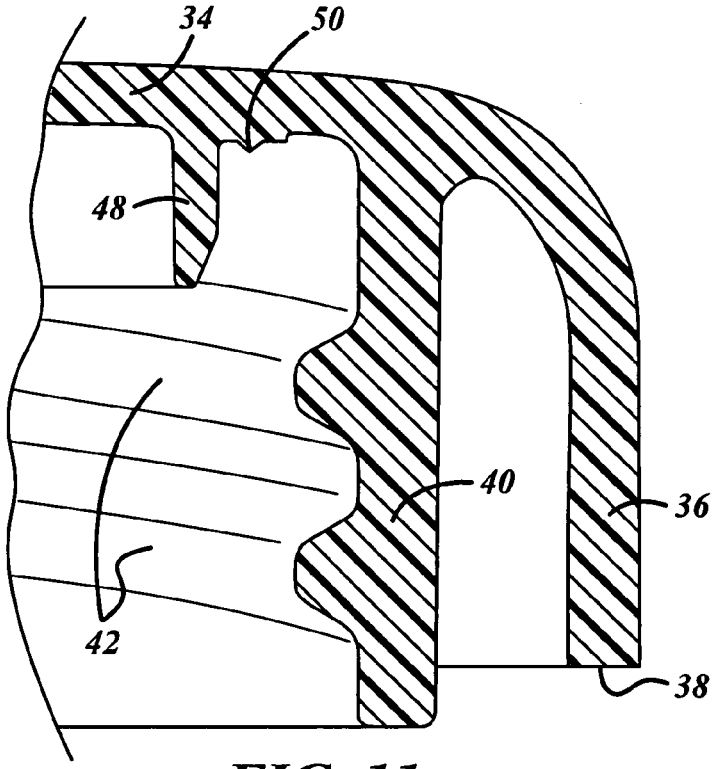
FIG. 11 is an enlarged view of the portion of FIG. 10 within the area 11.
Figure 12:
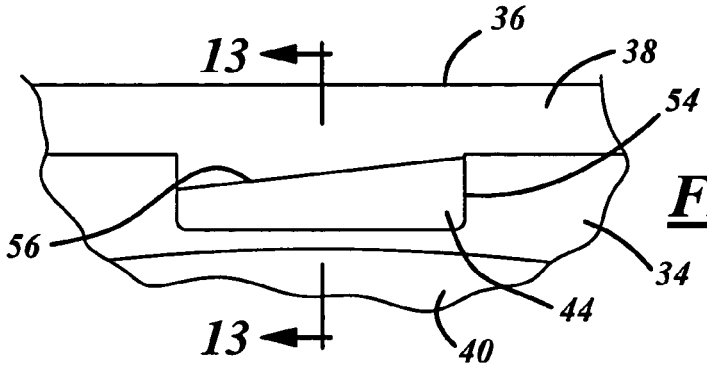
FIG. 12 is an enlargement of the portion of FIG. 9 within the area 12.
Figure 13:
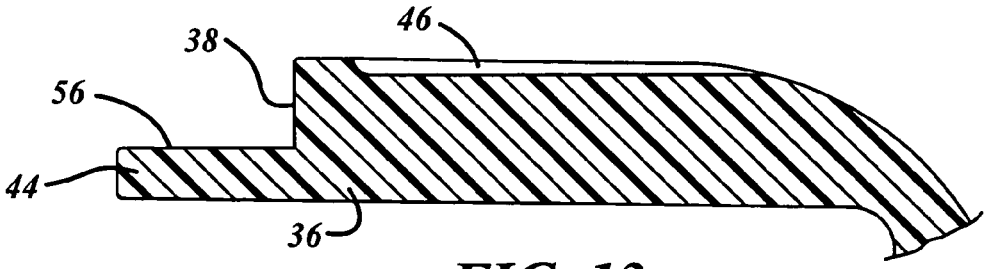
FIG. 13 is a fragmentary sectional view taken substantially along the line 13-13 in FIG. 12.

Lid 14 (FIGS. 1-4 and 9-13) preferably also is of one-piece molded plastic construction such as polypropylene and includes a base wall 34 that preferably is substantially flat. Base wall 34 has a rectangular periphery, preferably square, that is identical to the rectangular (preferably square) periphery of base 12. A continuous peripheral wall 36 extends entirely around the periphery of lid base wall 34 and has a free edge 38 that lies in a plane parallel to the plane of substantially flat base wall 34. A cylindrical wall 40 extends from base wall 34 within peripheral wall 36, preferably centrally within peripheral wall 36. Cylindrical wall 40 has at least one internal thread segment 42 that corresponds in number and geometry with the at least one external thread segment 24 on base 12. In the illustrated exemplary embodiment of the disclosure, there are four internal thread segments 42 with thread starts at 90° spacing around the inside of cylindrical wall 40. A pair of internal locking tabs 44 centrally extend from diametrically opposed linear sections of peripheral wall 36. External ribs or grooves 46 may be provided on peripheral wall 36 to identify the locations of tabs 44. Internal grooves 52 may be provided on wall 36 on opposed sides of tabs 44 to make wall 36 more flexible in the areas of tabs 44. Each tab 44 preferably has a clockwise-facing abutment face 54 (in the orientation of FIGS. 9 and 12) and an angulated partially counterclockwise-facing cam face 56. In the exemplary embodiment of the disclosure illustrated in the drawings, there preferably is an annular wall 48 that extends from base wall 34 of lid 14 for plug-sealing engagement within cylindrical wall 22 of base 12, as best seen in FIG. 3. Lid 14 may also include, in addition to or instead of plug seal wall 48, an annular bead 50 that extends from base wall 34 for sealing engagement with the end surface 26 of cylindrical wall 22 on base 12. Wall 48 and bead 50, when provided, preferably are coaxial with wall 40.

Figure 6:
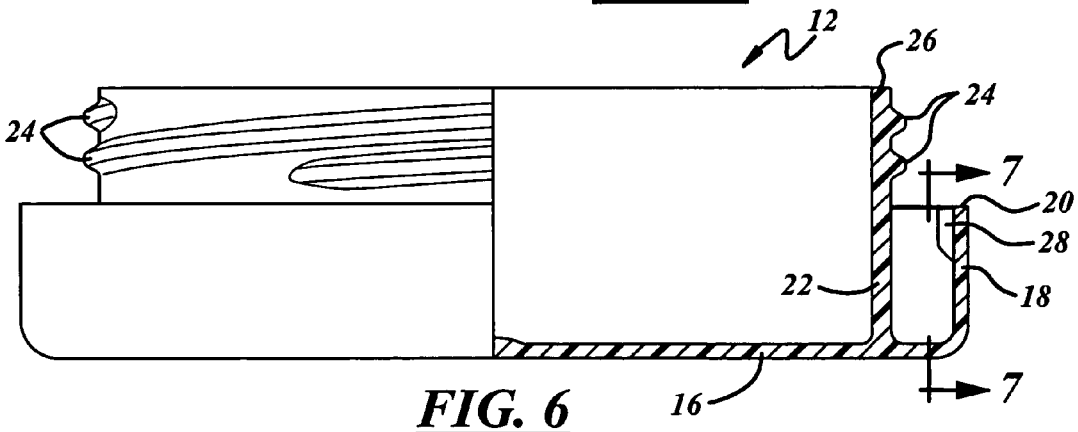
FIG. 6 is a sectional view taken substantially along the line 6-6 in FIG. 5.
Figure 7:
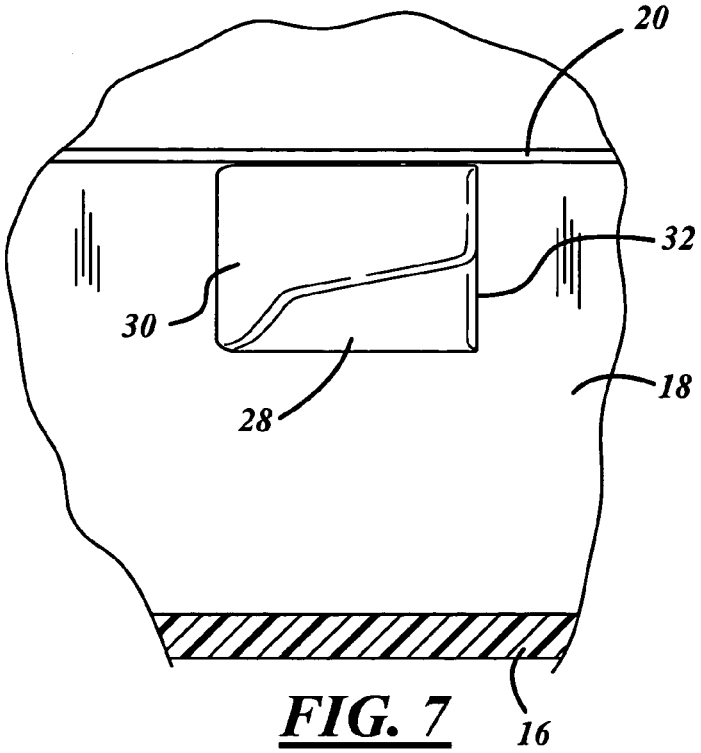
FIG. 7 is a fragmentary sectional view taken substantially along the line 7-7 in FIG. 6.
Figure 8:
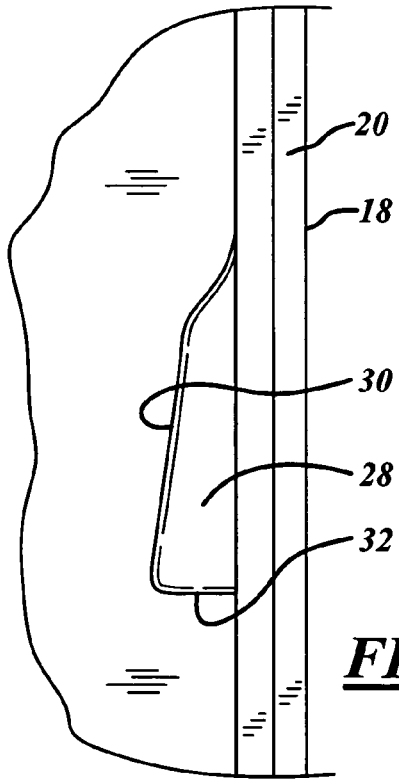
FIG. 8 is an enlarged view of the portion of FIG. 5 within the area 8.

To assemble the package, and after tablets or the like are placed within cylindrical wall 22 of base 12, lid 14 is threaded onto base 12 until edge 38 of peripheral wall 36 is in aligned end-wise abutment with the edge 20 of peripheral wall 18. During the final threading of lid 14 onto base 12 and just before the edges of the peripheral walls are brought into engagement, cam surfaces 56 of locking tabs 44 on lid 14 engage and ride over cam surfaces 30 of locking projections 28. Tabs 44 and the surrounding sections of peripheral wall 36 are resiliently flexed inwardly by surfaces 30 of projections 28 until tabs 44 snap behind abutment surfaces 32 of projections 28. Tabs 44 preferably are diametrically opposed to each other as best seen in FIG. 6, which is why locking projections 28 preferably are slightly offset from each other as best seen in FIG. 5. To remove lid 14 from base 12, peripheral wall 36 of lid 14 is resiliently flexed inwardly by manual squeezing of the opposing sections of peripheral wall 36 marked by grooves or ribs 46. When tabs 44 clear projections 28, lid 14 may be unthreaded to obtain access to the product within cylindrical wall 22 of base 12. After the base is filled with product and the lid applied by a packager, an external label 52 (FIG. 1) preferably is applied at least from base wall 34 of lid 14 around abutting sections of peripheral walls 36,18 and onto base wall 16 of base 12. Label 52 must be severed, such as along the parting line between the lid and base illustrated in phantom in FIG. 1, to permit unthreading of the lid and base from each other. This severing or tearing of the label provides an indication that the package has been opened.

There thus has been disclosed a child-resistant package that fully satisfies all of the objects and aims previously set forth. The disclosure has been presented in conjunction with an exemplary embodiment, and a number of modifications and variations have been described. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A child-resistant package that includes:

a first element having a base wall with a rectangular periphery, a continuous peripheral wall extending around said periphery, at least a pair of locking projections internally disposed on opposed sections of said peripheral wall, and a cylindrical wall extending from said base wall in the same direction as said peripheral wall of said first element and within said peripheral wall of said first element and having at least one first thread segment, and a second element having a base wall with a rectangular periphery and a continuous peripheral wall extending around said rectangular periphery, a pair of locking tabs centrally extending from opposed sections of said peripheral wall, and a cylindrical wall extending from said base wall in the same direction as said peripheral wall of said second element and within said peripheral wall of said second element and having at least one second thread segment, said second element being threadable onto said first element by means of said cylindrical walls and said first and second thread segments to bring said peripheral walls into aligned abutment and said locking tabs into engagement with said locking projections to resist unthreading of said elements, said peripheral wall of said second element being inwardly flexible and resilient adjacent to said locking tabs to move said locking tabs inward from said locking projections so that said elements can be unthreaded.

2. The package set forth in claim 1 wherein one of said first and second elements includes an annular wall for plug-sealing receipt within the cylindrical wall of the other element.

3. The package set forth in claim 1 wherein one of said first and second elements has an annular bead on said base wall for opposed sealing contact with an axial end surface of the cylindrical wall of the other element.

4. The package set forth in claim 1 wherein each of said elements includes plural thread segments on the associated cylindrical walls, and wherein said first element has locking projections internally disposed on all four sections of said peripheral wall.

5. The package set forth in claim 1 wherein said rectangular peripheries are square and identical.

6. The package set forth in claim 1 wherein said at least a pair of locking projections includes a locking projection internally disposed on each section of said peripheral wall of said first element.

7. The package set forth in claim 1 wherein said at least a pair of locking projections are centered but offset from one another.

8. The package set forth in claim 1 wherein said first element cylindrical wall has a free end for engagement against said base wall of said second element.

9. The package set forth in claim 1 wherein said package is a compact-style package, said first element is a compact-style first element, and said second element is a compact-style second element.

10. The package set forth in claim 1 including a label extending at least from said base wall of said second element around abutting sections of said peripheral walls onto said base wall of said first element, such that said label must be severed to permit unthreading of said elements to provide tamper indication for said package.

11. The package set forth in claim 10 wherein said base walls are substantially flat.

12. The package set forth in claim 1 wherein said locking projections have cam surfaces for camming said locking tabs inwardly as said first and second elements are threaded to each other, and abutment surfaces for engagement by said locking tabs to resist unthreading of said elements absent inward flexure of said peripheral wall of said second element.

13. The package set forth in claim 12 wherein said locking tabs have cam surfaces for engaging said cam surfaces on said locking projections and abutment surface for engaging said abutment surfaces on said projections.

14. A child-resistant package that includes:

a first element having a base wall with a rectangular periphery, a continuous peripheral wall extending around said periphery, at least a pair of locking projections internally disposed on opposed sections of said peripheral wall, and a cylindrical wall extending from said base wall in the same direction as said peripheral wall of said first element and within said peripheral wall of said first element and having at least one first thread segment, a second element having a base wall with a rectangular periphery and a continuous peripheral wall extending around said rectangular periphery, a pair of locking tabs centrally extending from opposed sections of said peripheral wall, and a cylindrical wall extending from said base wall in the same direction as said peripheral wall of said second element and within said peripheral wall of said second element and having at least one second thread segment, said second element being threadable onto said first element by means of said cylindrical walls and said first and second thread segments to bring said peripheral walls into aligned abutment and said locking tabs into engagement with said locking projections to resist unthreading of said elements, said peripheral wall of said second element being inwardly flexible and resilient adjacent to said locking tabs to move said locking tabs inward from said locking projections so that said elements can be unthreaded, at least one of said locking projections and said locking tabs having cam surfaces for camming said tabs inwardly as said first and second elements are threaded to each other, and abutment surfaces for engagement between said projections and tabs to resist unthreading of said elements absent inward flexure of said peripheral wall of said second element, and a label extending at least from said base wall of said second element around abutting sections of said peripheral walls onto said base wall of said first element, such that said label must be severed to permit unthreading of said elements to provide tamper indication for said package.

15. The package set forth in claim 14 wherein said base walls are substantially flat.

16. The package set forth in claim 14 wherein said rectangular peripheries are square and identical.

17. The package set forth in claim 14 wherein said at least a pair of locking projections includes a locking projection internally disposed on each section of said peripheral wall of said first element.

18. The package set forth in claim 14 wherein said at least a pair of locking projections are centered but offset from one another.

19. The package set forth in claim 14 wherein said first element cylindrical wall has a free end for engagement against said base wall of said second element.

20. The package set forth in claim 14 wherein said package is a compact-style package, said first element is a compact-style first element, and said second element is a compact-style second element.

21. The package set forth in claim 14 wherein said locking projections have cam surfaces for camming said locking tabs inwardly as said first and second elements are threaded to each other, and abutment surfaces for engagement by said locking tabs to resist unthreading of said elements absent inward flexure of said peripheral wall of said second element.

22. The package set forth in claim 21 wherein said locking tabs have cam surfaces for engaging said cam surfaces on said locking projections and abutment surface for engaging said abutment surfaces on said projections.

* * * * *